United States Patent [19]

Schindehutte

[11] Patent Number: 4,674,411

[45] Date of Patent: Jun. 23, 1987

[54] RAILROAD-VEHICLE TRUCK FRAME WITH TRANSOMS HAVING FLANGES AND CENTRAL WEBS

[75] Inventor: Manfred Schindehutte, Calden, Fed. Rep. of Germany

[73] Assignee: Wegmann & Co. GmbH, Kassel, Fed. Rep. of Germany

[21] Appl. No.: 790,907

[22] Filed: Oct. 24, 1985

[30] Foreign Application Priority Data

Oct. 30, 1984 [DE] Fed. Rep. of Germany ..... 3439616

[51] Int. Cl.[4] ..... B61F 5/52; B61F 5/06; B61F 5/14

[52] U.S. Cl. ..... 105/197.05; 105/199.3; 105/208

[58] Field of Search ..... 105/208, 208.1, 199 CB, 105/197.1, 197 D, 197 R, 182 R, 202, 199.3, 197.05

[56] References Cited

U.S. PATENT DOCUMENTS

| | | | |
|---|---|---|---|
| 630,358 | 8/1899 | King | 105/199 CB |
| 774,672 | 11/1904 | Kaylor | 105/202 |
| 1,358,043 | 11/1920 | Westlake | 105/197 R |
| 1,635,910 | 2/1925 | Tucker | 105/208 X |
| 1,821,296 | 9/1931 | Drenning | 105/199 CB |
| 2,060,550 | 11/1936 | Bower | 105/208 X |
| 2,168,293 | 8/1939 | Kiesel, Jr. | 105/182 R |
| 2,316,046 | 4/1943 | Buckwalter | 105/208 X |
| 3,880,089 | 4/1975 | Wallace | 105/197 DX |
| 3,905,305 | 9/1975 | Cope | 105/208 X |
| 4,030,424 | 6/1977 | Melcher et al. | 105/202 X |
| 4,082,043 | 4/1978 | Hammonds et al. | 105/208 X |
| 4,244,297 | 1/1981 | Monselle | 105/208 X |

*Primary Examiner*—Robert B. Reeves
*Assistant Examiner*—Scott H. Werny
*Attorney, Agent, or Firm*—Sprung Horn Kramer & Woods

[57] ABSTRACT

A railroad-vehicle truck with a frame that yields under torsion and consists of transoms (2) and side frames bars (1) welded into an H. The transoms (2) are positioned such that the planes that the transom webs (2k) lie in intersect at one line (S7), which lies between the flanges (21) of the transoms. Each of the flanges of the transoms are fastened to one of the upper and lower flanges on the depressed middle section of the side frame. Helical compression springs are positioned on the upper flanges of the depressed section, with a bolster on the springs, and load dependent side bearings between the compression springs and the bolster. The side frames are resistant to torque over their total length, but the transoms yield under torque. Thus the truck has sufficient corner rigidity and prevents high material stresses caused by torque.

4 Claims, 10 Drawing Figures

FIG.3
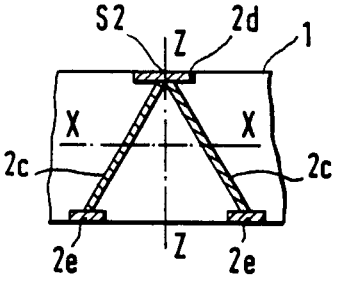
FIG.4
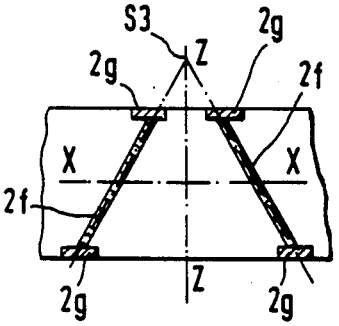
FIG.5
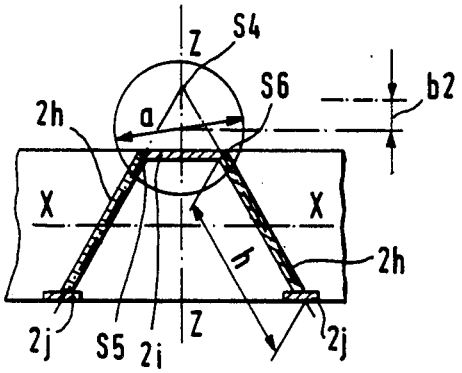
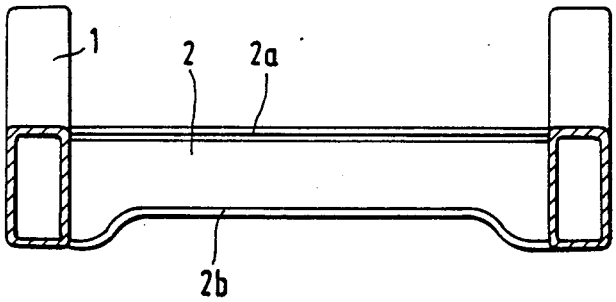
FIG.6

RAILROAD-VEHICLE TRUCK FRAME WITH TRANSOMS HAVING FLANGES AND CENTRAL WEBS

BACKGROUND OF THE INVENTION

The present invention relates to a railroad-vehicle truck with a frame that yields under torsion and consists of gantry supports or transoms and sole bars or side frames welded into an H, with the transoms also yielding under torsion.

Trucks that yield under torsion and have a central portion consisting essentially of two transoms (I sections for example) that yield under torsion and are welded to side frames that also yield under torsion, at least in the area between the transoms, are known. The area demarcated by the central portions of the transoms and side frames is reinforced with a transverse brace to increase the diagonal rigidity of the frame.

The ends of the sole bars in trucks without buffer beams are constructed to resist torsion and hence in the form of closed sections for instance. The side frames in trucks with buffer beams yield under torsion along their total length.

Trucks of the aforesaid type, which yield under torsion, are described for example in British Pat. No. 1,252,936 and U.S. Pat. No. 4,279,202.

The space for accommodating a truck of the aforesaid type is so limited in many practical cases, however, as to make them impossible to employ.

The maximum permissible axle base, wheel diameter, and space taken up by the shoe brake in some known freight-car trucks for example are givens. The remaining central portion of the truck is too narrow to allow a long enough torsion section in the middle of the side frame. The consequence is that the torsion of the truck will produce higher material stresses, especially at the transitions between the middle of the side frames, which yields under torison, and their torsion-resistant ends.

This is especially true of the type of truck described in British Pat. No. 1,252,936.

Since a maximum permissible overall height must also be adhered to, making it necessary to employ side frames with a depression, and since the maximum permissible overall length prevents the employment of a buffer beam, the type of truck described in U.S. Pat. No. 4,279,202 must also be ruled out.

A rigid-corner frame that yields subject to torsion is on the other hand a particular advantage in freight-car trucks.

Freight-car trucks with a frame that consists of two side frames that are not joined at a central portion are known. The sole bars are kept separate by the wheel sets, and the helical compression springs that support the bolster are positioned in an aperture in each side frame. The bolster also extends into the aperture. Vibration is accommodated in these trucks by means of spring-loaded wedges between the bolster and the truck frame. This type of truck includes those with constant swing restriction and those with load-dependent swing restriction.

The decisive drawback to this type of truck is the lack of corner rigidity. The right angle between the midline of the side frame and the wheel set can deform into a parallelogram when the train travels over a curve, through a point, or in general past any irregularity in the track. This leads to increased load on the wheel flanges and hence to higher wear and a greater tendency to derail. A structure of this type also tends to run unstably (zig-zag) even at low speeds.

The known trucks also have other drawbacks.

The spring-support base must equal that of the axle bearings, and the transverse stop between the bolster and the side frames must be approximately as high as the center of the wheel set to prevent the axle bearings from going askew or even the sole bars going aslant with respect to its longitudinal axis.

Since the transverse stop is a component of the bolster, the bolster is positioned directly above the center of the axle and the springs essentially under it. The low position of the springs (increased distance from the center of gravity of the car) and the relatively small bearing distance have a deleterious effect on the rolling stability of the vehicle.

SUMMARY OF THE INVENTION

The object of the present invention is to provide a railroad-vehicle truck with a frame that yields under torque, of the type discussed in the foregoing, with a frame that yields under torsion and consists of transoms and side frames welded into an H, with the transoms also yielding under torsion, that will yield extensively under torque while having sufficient corner rigidity and that will not be subject to high material stresses as the result of the torque.

The truck will also comprise a simple and stable-running embodiment intended for freight cars that avoids the aforesaid drawbacks typical of known freight-car trucks.

This object is attained in accordance with the invention in that the side frames are resistant to torque over their total length and the transoms are positioned such that the planes that the transoms' webs lie in intersect at one or more lines, which lie within an imaginary cylinder with a diameter a that is 75% or less of the height h of the highest transoms.

The side frames in the truck in accordance with the invention are resistant to torque over their total length and can consequently be box sections for example. Their central portion is composed of several transoms that yield under torque, whereby one essential principle of the invention is that the transoms' webs do not lie in parallel planes, but in planes that intersect at transverse lines, with the webs, which can be I or T sections for example, being relatively narrow. As will be described later herein with reference to certain embodiments, this results in high yield under torque accompanied by sufficient corner rigidity. It produces a truck frame that yields under torque and reacts to external torque with only very slight material stresses.

The truck in accordance with the invention, with its frame that yields so readily under torque, is particularly practical for freight cars, in which the side bearings that limit the outward swing of the truck are positioned on top of the bolster on each side of the center pin, each swing restrictor having a friction structure with a slide face on the superstructure resting against it, and the friction structure resting against the bolster on a leaf spring that extends along the truck with one end rigidly fastened to the bolster and the other end resting in such a way that it can move back and forth along the truck on a mount that is attached to the bolster. This embodiment to some extent combines characteristics of known trucks with characteristics of the truck in accordance with the invention to provide a truck with optimal running properties.

Some preferred embodiments of the invention will now be described with reference to the attached drawings, wherein

BRIEF DESCRIPTION OF THE DRAWINGS

FIGS. 3 through 5 are partial sections through variants of the embodiment illustrated in FIG. 2, FIG. 6 is a section along the line VI—VI in FIG. 1.

DETAILED DESCRIPTION OF THE PREFERRED EMBODIMENTS

Figure 1:
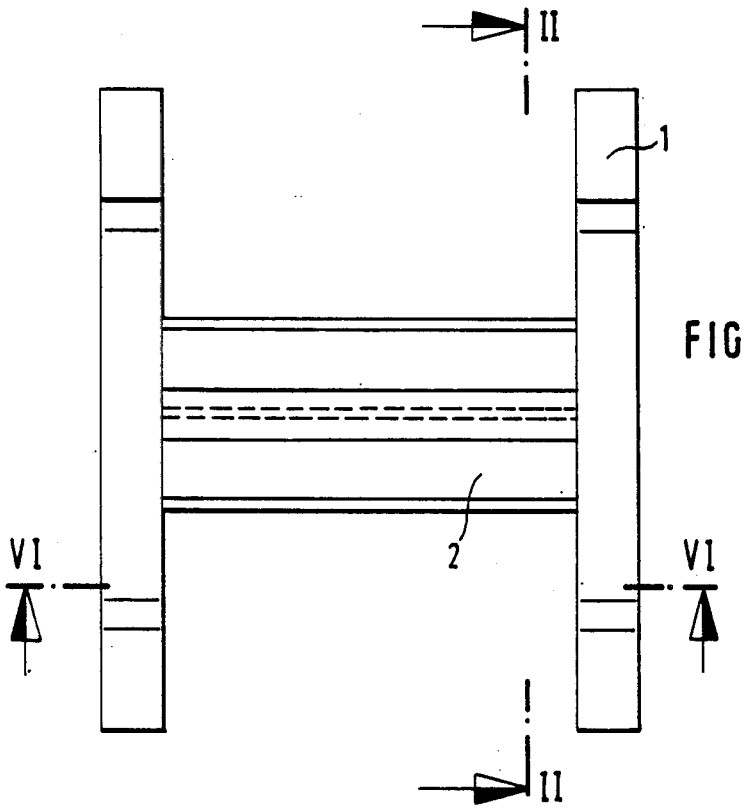
FIG. 1 is a top view of an H-type truck frame.
Figure 2:
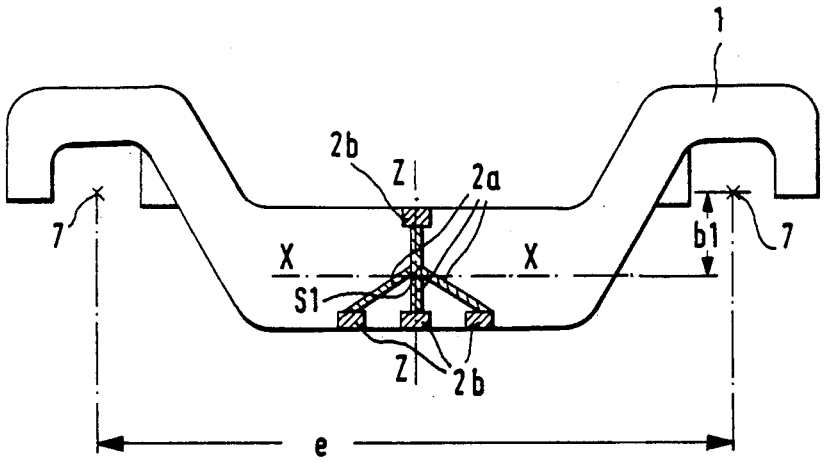
FIG. 2 is a section along the line II—II in FIG. 1.
Figure 7:
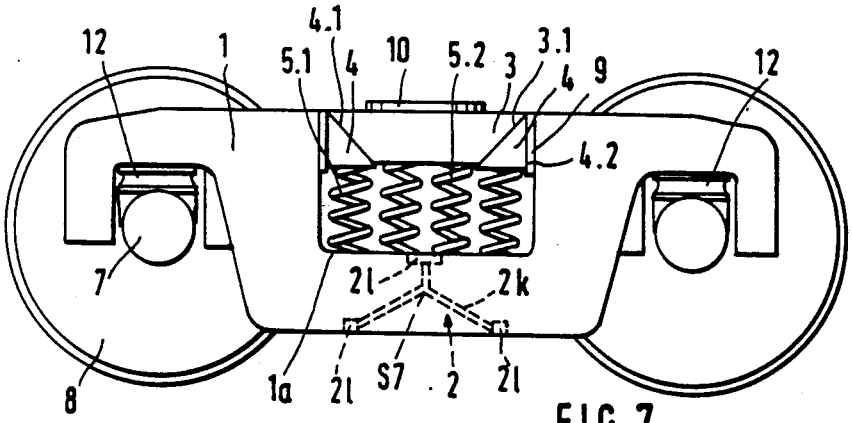
FIG. 7 is a side view of a truck with a frame that yields under torque in accordance with the invention.
Figure 8:
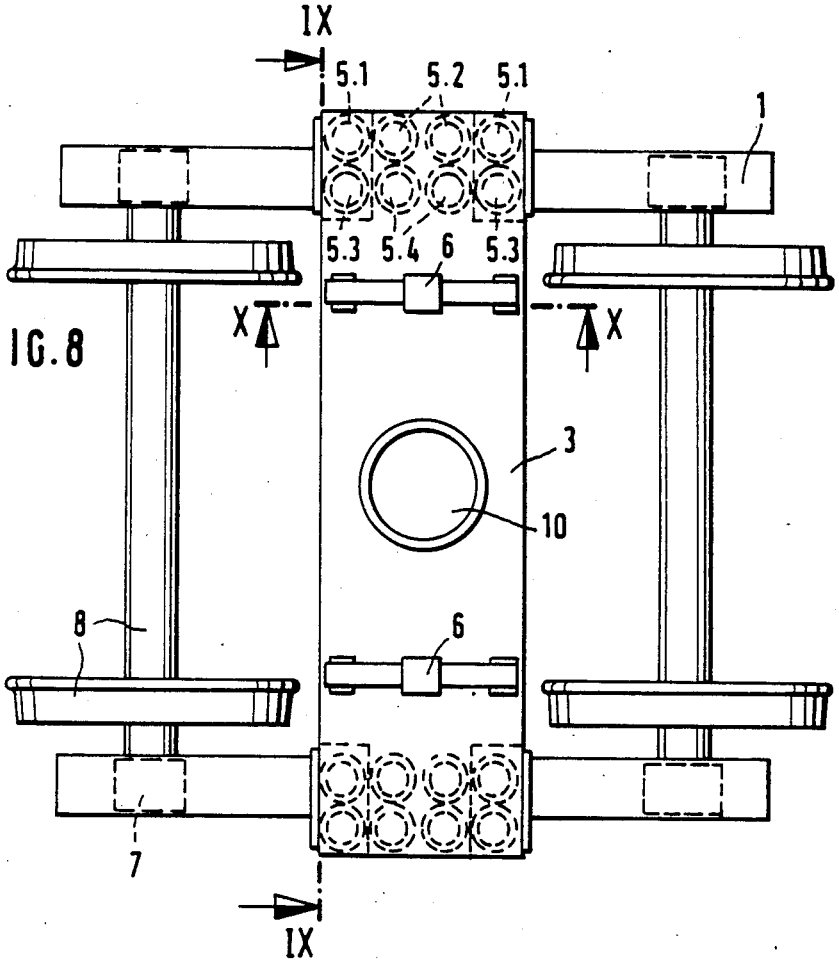
FIG. 8 is a top view of the truck illustrated in FIG. 7.
Figure 9:
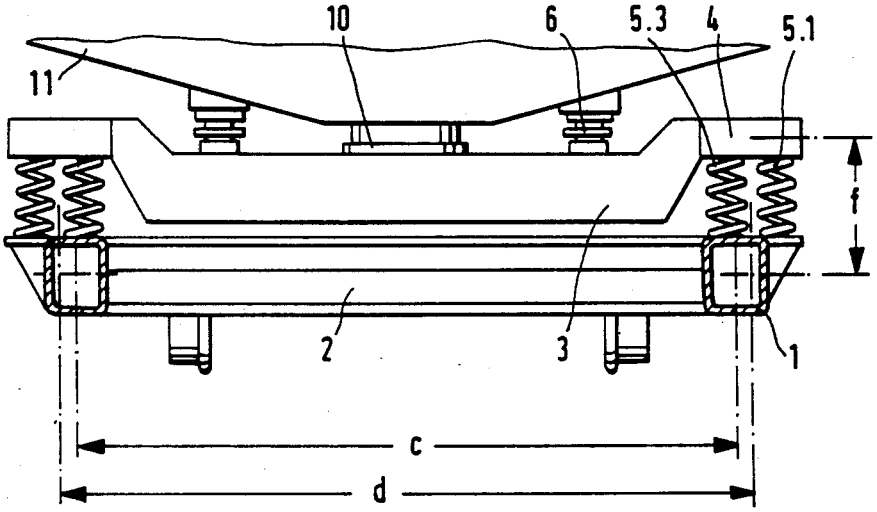
FIG. 9 is a section along the line IX—IX in FIG. 8.
Figure 10:
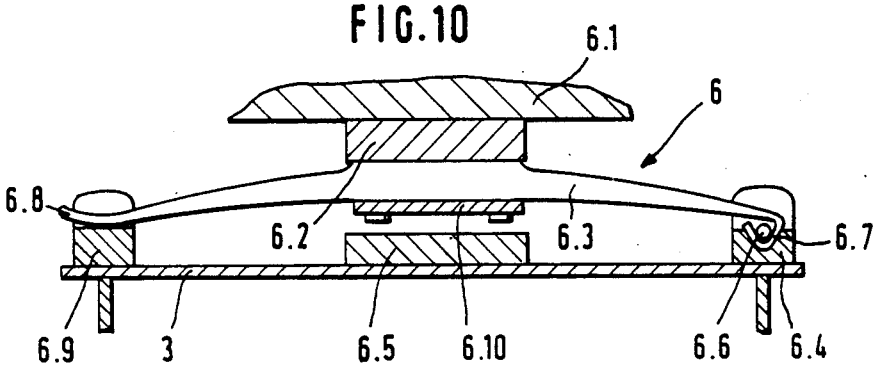
FIG. 10 is a section along the line X—X in FIG. 8.

The railroad-vehicle truck frame, which yields under torque, illustrated in FIGS. 1 and 2 has two torque-resistant side frames 1, which can for example be box sections and which have a depression in the middle.

Side frames 1 are attached at the middle with transoms 2 that yield under torque. Their cross-section will be evident from FIGS. 2 through 5. The transoms 2 in FIG. 2 for instance are essentially webs 2*a* with edges reinforced by flanges 2*b*. They can be either I sections or T sections. Flanges 2*b* are intended to render webs 2*a* stable with respect to buckling and to increase the bending strength of the central portion of the truck frame in relation to the X and Y axes. Rigid side frames 1 will theoretically protect the truck frame from torque least effectively when the planes that webs 2*a* lie in all intersect at the same line. Such an embodiment is illustrated in FIG. 2, with variants illustrated in FIGS. 3 and 4.

The transom flanges 2*b* in the embodiment illustrated in FIG. 2 are at acute angles to one another and intersect at a line S1 approximately at the middle of the depression in sole bar 1 and at a distance b1 from the axis of the schematically indicated wheel bearing 7.

The line S2 that the two transom webs 2*c* intersect at in the embodiment illustrated in FIG. 3 is approximately at the top of side frame 1, where transoms 2 have a common upper flange 2*d*, their lower flanges 2*e* being separate.

Although the transom webs 2*f* in the embodiment illustrated in FIG. 4 do not actually intersect, their planes do intersect at a line S3 above sole bar 1. Transoms 2 have separate upper and lower flanges 2*g*.

It has been demonstrated that it is sufficient in practice for the aforesaid rule with respect to the line of intersection of the planes of the transom planes to be complied with only approximately. When the central portion of the truck frame consists of more than two transoms or more than two transom webs, there can be several directly adjacent plane-intersection lines. It can also be practical, to improve weldability for instance, to design the transoms somewhat differently, as illustrated in FIG. 5 for example. The slight antitorque property that must be taken into account can be kept within acceptable limits if a somewhat more general condition is satisfied.

It is only necessary, when the planes that the transom webs lie in intersect at several parallel lines, for the lines S4, S5, and S6 to be inside an imaginary cylinder with a diameter a that is 75% or less of the height h of the highest transom.

The embodiment illustrated in FIG. 5 satisfies this condition, with the "height" h of the transom web measured along the plane of the web.

The transoms 2 in the embodiment illustrated in FIG. 5 have separate lower flanges 2*j*, and transom webs 2*h* do not touch, but are connected by an edge reinforcement or common upper flange 2*i*. The planes that both transom webs 2*h* lie in intersect at a line S4 and intersect the plane of common upper flange 2*i*, which can be considered an additional web, at lines S5 and S6. The aforesaid relationship also holds true for line S4, S5, and S6 of intersection.

Since the corner rigidity of the truck frame decreases as the distance of the imaginary cylinder with diameter a from the plane of the wheel axles increases, as, that is, the parallelism of transom webs 2*h* increases, it is an advantage for the distance b2 of the central axis of the cylinder from the plane that the wheel axles lie in to be 25% or less of axle base e (FIG. 2). The same ratio holds for the distance b1 (FIG. 2) of the sole line of intersection of the transom webs from the plane of the wheel axles.

The cross-sections of possible types of transoms in FIGS. 2 through 5 only illustrate some examples. Obviously, there is a whole series of further potential types that comply with the aforesaid conditions.

Since the transom flanges illustrated in FIGS. 2 through 5 make the truck frame more rigid and must still have a certain cross-sectional area to avoid exceeding permissible material-stress values and to facilitate welding, keeping the widths of the upper and lower flanges less than seven times their thickness is to be recommended.

It can also be an advantage, in order to keep the reinforcement of the truck frame small, to provide a depression in the transom webs in the vicinity of where they attach to the side frames as illustrated in FIG. 6.

FIGS. 7 to 10 illustrate a truck that is especially intended for freight cars. Its frame, as will be evident from FIG. 7, consists of torque-resistant side frames 1 that have a depression in the middle and of transoms 2 that yield under torque. This embodiment is welded together like that illustrated in FIG. 2. Transoms 2 are T sections with their intermediate webs 2*k* at an obtuse angle to each other and ending at a line S7 of intersection, where they are welded together. The flanges 21 of transoms 2 are fastened to the upper and lower flanges of side frames 1.

The employment of a truck frame of this type, which yields under torque but is rigid at the corners, eliminates the significance of the vertical rigidity of the primary suspension in distributing wheel load. The primary suspension can accordingly be embodied by simple rubber thrust springs 12 between the wheel bearings 7 that support the wheel sets 8 and the ends of sole bars 1.

Since the sole bars 1 in this truck are connected by the aforementioned central portion, it is possible to position the secondary suspension and transverse stops where they will be especially practical from the aspect of running engineering. The secondary suspension, which is embodied in the present case by helical springs 5.1 to 5.4, is positioned as high as possible by supporting the springs on the upper flanges 1*a* of side frames 1. This truck has a bolster 3 directly supported on helical springs 5.2 and 5.4. A particular advantage here is that the helical compression springs are not positioned symmetrically with respect to the middle of the side frames (which equals the middle of the wheel bearing) more or less at a distance c (FIG. 9), but are displaced outward, so that their mean distance is increased to d.

Between bolster 3 and the truck frame is a load-dependent swing restrictor or side bearing 6. Side bearings of this type are known. The particular design of the frame in this truck makes it possible to attain a greater vertical distance f (FIG. 9) between the slide face and the center of gravity of the cross-section of the central portion of the side frames.

Side bearings 6 has slide wedges 4 on the top of the helical compression springs 5.1 and 5.3 that are frontmost and rearmost along the direction of travel. Slide wedges 4 have downward-slanting slide faces 4.1 that matching slide faces 3.1 on the side of bolster 3 rest against. The vertical slide faces 4.2 of slide wedges 4 rest against other vertical slide faces 9 that are rigidly fastened to side frames 1. As will be directly apparent from FIG. 7, slide wedges 4 are forced out against slide faces 9 as load increases. The force that a slide wedge 4 is forced against slide face 9 with generates a bending moment in the middle of side frame 1 that opposes the bending moment from the vertical loads and partly compensates for it.

Bolster 3 is attached to superstructure 11 with a center pin or footstep 10.

Since running may be unstable under certain conditions at speeds above 90 km/h with this type of truck, there is an additional side bearing 6 on both sides of the center pin that opposes the rotation of the truck in relation to superstructure 11.

This is embodied in permanently loaded friction structures 6.2 that slide against a slide face 6.1 attached to the superstructure 11 when the truck swings out. Thus, the frictional force of friction structures 6.2 brakes the swing of the truck.

The desired stabilizing action occurs, however, only when the frictional force is transferred to the truck frame without play.

The aforesaid frictional swing restriction between bolster 3 and truck frame 1 and 2 always allows longitudinal transfer without play. The transfer of frictional force without play between friction structure 6.2 and bolster 3 is attained by a design that will now be described.

Friction structure 6.2 is screwed onto the middle of a leaf spring 6.3. The two ends 6.7 and 6.8 of leaf spring 6.3 rest against bolster 3. The end 6.7 of the leaf spring is bent into an eye and rests in a prismatic guide in a mount 6.4 attached to bolster 3. It is secured in the mount with a retaining bolt 6.6. The other end 6.8 of leaf spring 6.3 slides freely and longitudinally with respect to the truck in another mount 6.9 attached to the bolster. A stop 6.10 that is positioned on the bottom of leaf spring 6.3 and operates in conjunction with a counterstop 6.5 on cradle frame 3 prevents the spring from being overstressed when the car is struck from the side and comes to rest against lateral friction structures 6.2.

What is claimed is:

1. In a railroad-vehicle truck with a frame that yields under torsion and comprises transoms and side frames welded into an H-type frame, the improvement wherein the side frames are resistant to torque over their total length and have a depressed section at the middle of the truck having upper and lower flanges, wherein the transoms yield under torsion and comprise T sections, having flanges and central webs, that are at obtuse angles to one another and that abut at their ends in a line of intersection which is positioned between the flanges of said transoms and along which the webs are welded together, wherein each of the flanges of the transoms are fastened to one of the upper and lower flanges on the side frames and further comprising helical compression springs positioned on the upper flanges of the depressed section of the side frames, a bolster supported on the springs, axle bearings, axle guides connecting the axle bearings to ends of the side frames comprising rubber thrust springs, and load-dependent side bearings positioned between at least some of the helical compression springs and the bolster.

2. The truck as in claim 1, wherein the side bearings have slide wedges on the top of the helical compression springs that are frontmost and rearmost along the direction of travel, wherein the bolster has downward slant slide face on sides thereof and the side frames have vertical slide faces thereon and wherein the slide wedges have downward-slanting slide faces matching the slide faces on the sides of the bolster and resting thereagainst the vertical slide faces which rest against the vertical slide faces of the transoms.

3. The truck as in claim 2, wherein the helical compression springs are displaced asymmetrically, laterally outward with respect to a middle portion of the side frames.

4. The truck as in claim 1, further comprising second side bearings for limiting the outward swing of the truck and positioned on top of the bolster on each side of a center pin, each side bearing having a friction structure with a slide face on a superstructure resting against it, and the friction structure resting against the bolster on a leaf spring that extends along the truck with one end rigidly fastened to the bolster and the other end resting such that it can move back and forth along the truck on a mount that is attached to the bolster.

* * * * *